United States Patent [19]

Kerner

[11] 4,180,046

[45] Dec. 25, 1979

[54] RADIUS AND ANGLE DRESSER

[76] Inventor: Ronald E. Kerner, 57 Grove St., Plainville, Conn. 06062

[21] Appl. No.: 868,987

[22] Filed: Jan. 12, 1978

Related U.S. Application Data

[63] Continuation-in-part of Ser. No. 671,304, Mar. 29, 1976, abandoned.

[51] Int. Cl.[2] ..... B24B 53/06

[52] U.S. Cl. ..... 125/11 A; 125/11 AT

[58] Field of Search ..... 125/11 R, 11 AT, 11 A, 125/11 AS; 51/216 H

[56] References Cited

U.S. PATENT DOCUMENTS

| | | | |
|---|---|---|---|
| 1,994,386 | 3/1935 | Dardani | 125/11 AT |
| 2,301,610 | 11/1942 | Brady | 125/11 |
| 2,336,758 | 12/1943 | Statia | 125/11 R |
| 2,343,949 | 3/1944 | Bellinger | 125/11 R |
| 2,642,856 | 6/1953 | Calloway | 125/11 AT |
| 2,741,241 | 4/1956 | Teather | 125/11 |
| 2,744,515 | 5/1956 | Braderick | 125/11 AT |
| 2,815,017 | 12/1957 | Bordonaro | 125/11 AT |
| 3,006,331 | 10/1961 | Akhert | 125/11 AT |
| 3,685,505 | 8/1972 | Rohrle | 125/11 AT |

*Primary Examiner*—Harold D. Whitehead

[57] ABSTRACT

A radius and angle dresser includes a support member having a first shaft rotatably mounted thereon and a second shaft rotatably mounted at one end of the first shaft. The respective axes of rotation of the shafts are parallel and the second shaft is radially shiftable in two mutually perpendicular directions relative to the first shaft to radially offset the two shafts while keeping them parallel. Locking means are associated with the shafts to enable selective independent rotation of the second shaft or rotation of the second shaft with the first shaft.

The apparatus permits the method of generating of different radius surfaces about, respectively, the axes of rotation of the first and second shafts without intervening re-zeroing and re-setting of the device.

11 Claims, 14 Drawing Figures

RADIUS AND ANGLE DRESSER

CROSS REFERENCE TO RELATED APPLICATION

This application is a continuation in part of my copending application Ser. No. 671,304 filed Mar. 29, 1976 and entitled "Radius and Angle Dresser now abandoned."

BACKGROUND OF THE INVENTION

Radius and angle dressers for figuring the edges of grinding wheels to desired configurations have heretofore been capable of forming edge surfaces having a combination of rectilinear and single radius arcuate cross sections. Exemplary of such dressers are those disclosed in U.S. Pat. No. 1,994,386 issued to T. H. Dardani on Mar. 12, 1935. U.S. Pat. No. 2,343,949 issued to F. S. Bellinger on Mar. 15, 1944 and U.S. Pat. No. 2,336,758 issued to E. V. Statia Sr. on Dec. 14, 1943.

The prior art dressers, however, are incapable of generating tangent concave, convex and angled or double radius and angled grinding wheel edge surfaces without rezeroing and resetting the apparatus, which requires a precise and difficult repositioning of the cutting edge of a tool.

It is an object of the present invention to provide a novel radius and angle dresser for forming the edge surface of a grinding wheel to various compound configurations with an initial setting of the radii to be generated.

It is also an object to provide a novel radius and single dresser capable of forming tangent concave and convex grinding wheel edge surface configurations.

Another object is to provide such a radius and angle dresser capable of forming double radius grinding wheel edge surface configurations.

SUMMARY OF THE INVENTION

In accordance with the present invention, there is provided a radius and angle dresser comprising a support member having a first cylindrical aperture extending therethrough. A first shaft is on the support member and first mounting means on the first shaft serve to mount the first shaft in the first aperture for rotation, without axial movement, relative to the support member. First shaft locking means are operatively connected between the first shaft and the support member to selectively limit rotation of the first shaft from no rotation to limited rotary oscillation relative to the support member. A mounting member is secured to an end of the first shaft for rotation therewith about the axis of rotation of the first shaft and it has a linear track extending perpendicularly to the axis of rotation of the first shaft. A slide member is slidably mounted on the track for linear movement along the track perpendicularly of the axis of rotation of the first shaft and means for limiting movement of the slide member along the track are provided. A slide block having a second cylindrical aperture extending therethrough is slidably mounted on the slide member for linear movement thereon perpendicularly to the longitudinal axis of the track and to the axis of rotation of the first shaft. Means for locking the slide block in a selected fixed position along the slide member are provided.

A second shaft is on the slide block, the axis of rotation of the second shaft being parallel to that of the first shaft and perpendicular to the longitudinal axis of the track. Second mounting means are on the second shaft and serve to mount the second shaft in the second aperture for rotation about the longitudinal axis of the second shaft, without axial movement, relative to the slide block. Second shaft locking means are operatively connected between the second shaft and the slide block to selectively limit rotation of the second shaft from no rotation to limited rotary oscillation relative to the slide block. A tool support member is mounted adjacent an end of the second shaft for movement perpendicularly to the axis of rotation of the second shaft, and means for locking the tool support member in a fixed position on the second shaft are provided. A cutting tool mounting means is on the tool support member for mounting a cutting tool to provide a cutting edge thereof angularly disposed relative to the axes of rotation of the shafts, the tool support member being moveable on the second shaft to move the cutting edge of the associated cutting tool between extreme positions on opposite sides of the axis of rotation of the second shaft, and the slide block being slidable on the slide member to move the cutting edge of the associated cutting tool between extreme positions on opposite sides of the axis of rotation of the said first shaft. In this way, appropriate settings of the first and second shaft locking means may be employed to rotate the first shaft during operation of the dresser for rotation of the second shaft therewith to oscillate the associated cutting tool about the axis of rotation of the first shaft, and to rotate the second shaft during operation of the dresser independently of the first shaft to oscillate the associated cutting tool about the axis of rotation of the second shaft.

In accordance with one aspect of the invention, the first mounting means comprises two elements spaced apart along and mounted on the first shaft and disposed, respectively, adjacent opposite ends of the first cylindrical aperture, these elements each having a bearing face extending radially outwardly of the first aperture to provide respective bearing shoulders retaining the first shaft axially immovably within said first aperture. The second mounting means may be provided by similar elements each having a bearing face extending radially outwardly of the second aperture to provide respective bearing shoulders retaining the second shaft axially immovably within the second aperture.

In accordance with another aspect of the invention, the first shaft locking means comprises first stop means mounted on the first shaft and a first stop member mounted on the support member, the first stop means cooperating with the first stop member to limit rotation of the first shaft. Similarly, the second shaft locking means may comprise second stop means mounted on the second shaft and a second stop member mounted on the slide block, the second stop means cooperating with the second stop member to limit rotation of the second shaft.

Handles may be provided for rotation of the shafts and dial indicators employed to indicate the rotational orientation of the shafts.

The present invention also provides, in a method of dressing a grinding wheel or the like to provide two different radii surfaces thereon, the following step. Mounting a cutting tool having a cutting edge on a tool support member of a radius and angle dresser having a support member in which a first shaft is mounted for rotation and has a second rotatable shaft mounted at one end thereof. The respective axes of rotation of the shafts are parallel. The second shaft is selectively radially shiftable relative to the first shaft between positions lying in a first plane extending to opposite sides of the axis of rotation of the first shaft, while maintaining the axes of rotation parallel. First and second locking means are associated, respectively, with the first and second shafts and are operable for no or limited rotary oscillation of the shafts. The dresser is zeroed by rotationally centering said first and second shafts, and the cutting tool is positioned relative to the second shaft to position the cutting edge thereof at a selected elevation relative to the axis of rotation of the second shaft. The second shaft is radially shifted relative to the first shaft to position the cutting edge at a selected elevation relative to the axis of rotation of the first shaft. A grinding wheel or the like to be dressed is positioned adjacent to the cutting edge and the second shaft is locked against rotation relative to the first shaft. The first shaft is freed for a selected degree of rotational oscillation relative to the supporting member.

The first shaft is rotationally oscillated about its axis of rotation to engage the cutting edge with the associated grinding wheel or the like to generate thereon a radius surface set with respect to the axis of rotation of the first shaft. The first shaft is locked at a selected rotational position along its path of oscillation relative to the support member. The second shaft is freed for a selected degree of rotational oscillation relative to the first shaft, rotationally oscillated about its axis of rotation to engage the cutting edge with the associated grinding wheel or the like to generate thereon a radius surface set with respect to the axis of rotation of the second shaft. The first and second radius surfaces are thus generated without intervening repositioning of the cutting tool relative to the shafts.

DETAILED DESCRIPTION OF THE ILLUSTRATED EMBODIMENT

Figure 1:
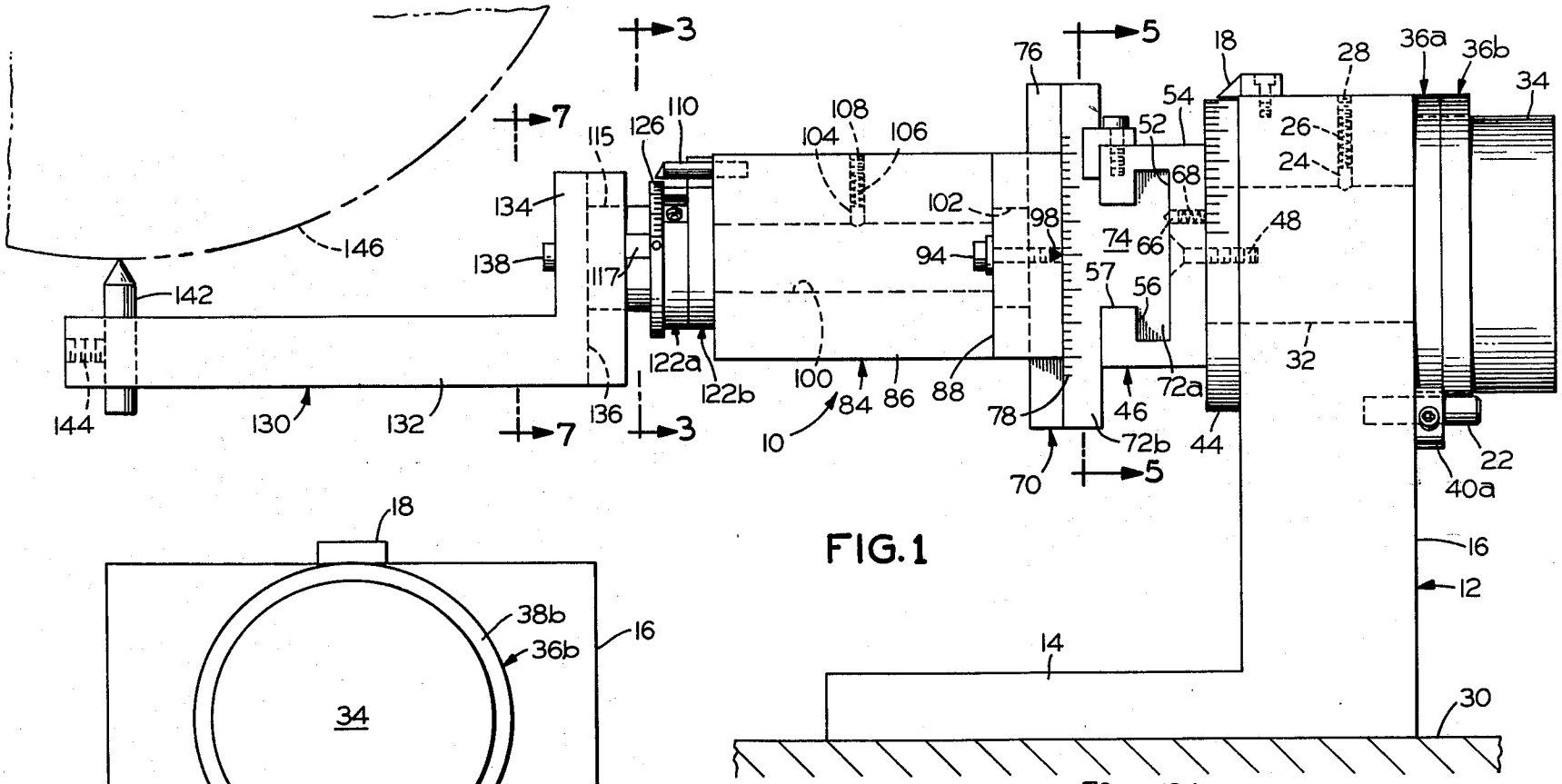
FIG. 1 is a side elevational view of a radius and angle dresser embodying the present invention with dotted lines showing internal structure and with a grinding wheel shown in phantom line.

Turning now to the attached drawings in detail and in particular to FIGS. 1–10 thereof, illustrated therein is a radius and angle dresser embodying the present invention generally designated by the numeral 10 and comprising an L-shaped support member generally designated by the numeral 12 having a horizontal leg 14 and vertical leg 16. The leg 16 has an indicator 18 secured to the top surface thereof by a threaded fastener 20 and a stop pin 22 secured in an aperture in a vertical surface thereof. A zeroing pin 24 is seated in an aperture in the top surface of the leg 16 and is biased inwardly thereof into a cylindrical aperture 33 extending as a bore through leg 16, for a purpose described hereinafter by a spring 26 retained in position by a set screw 28. As shown in FIG. 1, the dresser 10 is mounted on a suitable work table 30 and is generally secured thereto.

A first shaft 32 extends horizontally in aperture 33 through the leg 16 of the support member 10 and is rotatably seated therein. Suitable bearing means (not shown) may be provided to reduce friction. Secured to one end of the shaft 32 is a cylindrical handle member 34 which has a pair of annular clamp members generally designated by the numerals 36*a, b* extending about the circumference thereof adjacent the leg 16.

Figure 2:
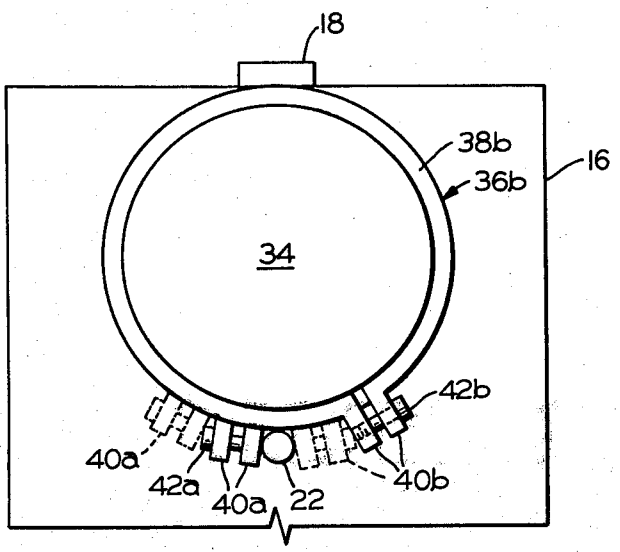
FIG. 2 is a fragmentary and elevational view of the right hand end of the dresser as seen in FIG. 1 with broken lines illustrating a rotated position of the stop members.

As shown in FIG. 2, each clamp member 36 comprises a ring portion 38 having a pair of free ends from which legs 40 extend perpendicularly to the ring portion 38, a threaded fastener 42 extending through the legs 40 and functioning in a known manner to lock the clamp member 36 in tightly fitting engagement to the handle member 34. Handle member 34 is seen to comprise an enlarged diameter portion of shaft 32 and may be considered to be an enlarged diameter member mounted thereon. One end of the enlarged diameter portion is disposed adjacent one end of aperture 33. The shoulder formed by the end of the enlarged diameter portion provides a bearing face which extends radially outwardly of one end of aperture 33 and cooperates with dial member 44 to retain shaft 32 rotatably within aperture 33. The legs 40*a, b* of clamp members 36 are disposed on opposite sides of the pin 22 to limit rotation, more specifically, rotary oscillation, of the shaft 32 to the desired range, and if no rotation is desired the clamp members 36 are locked in position with the legs 40*a, b* abutting opposite sides of the pin 22. Thus, clamps 36 and pin 22 together comprise the first shaft locking means.

Figure 4:
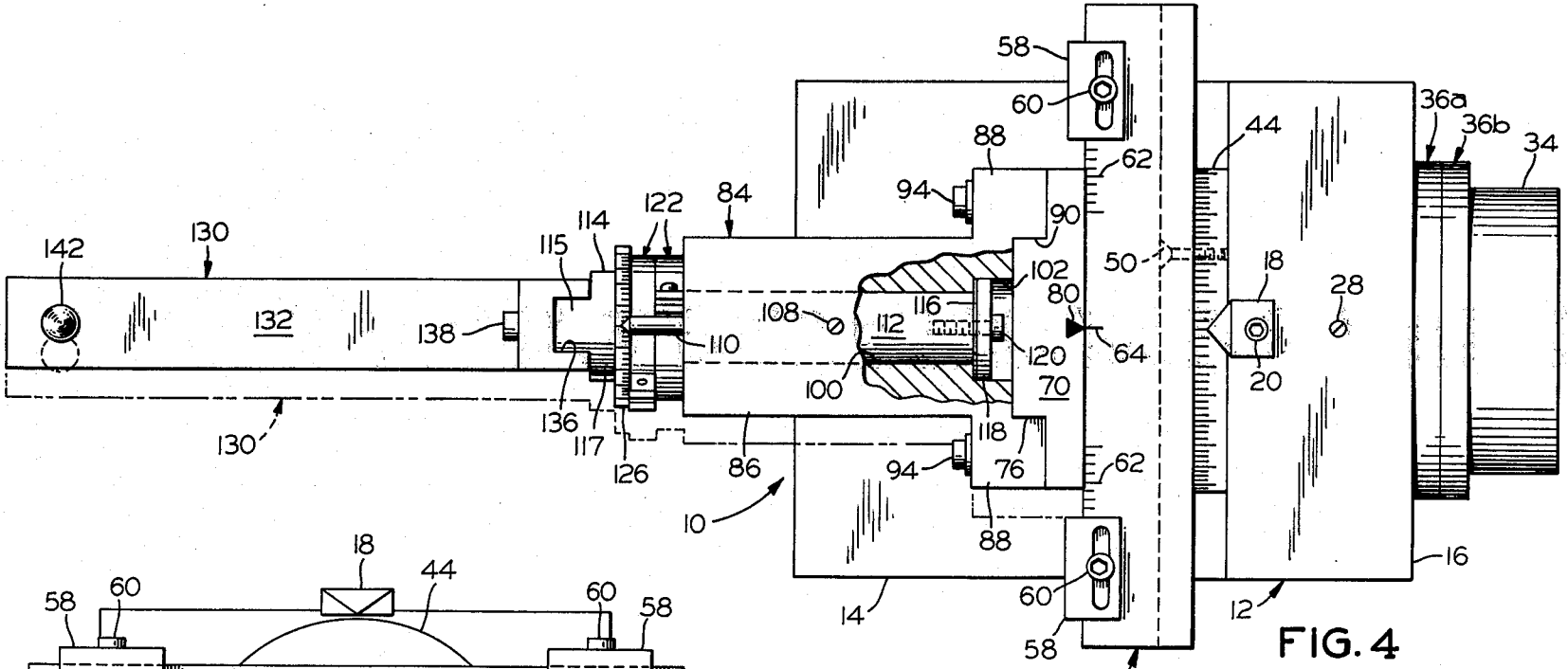
FIG. 4 is a plan view with a portion broken away to show internal structure and with phantom lines indicating a transposed position of the slide block, slide member and tool support member.

Mounted on the other end of the shaft 32 for rotation therewith are an annular dial member 44 graduated in degrees and an elongated mounting member generally designated by the numeral 46 extending perpendicularly to the rotational axis of shaft 32. As shown best in FIGS. 1 and 2, the mounting member 46 is secured to the shaft 32 by a threaded fastener 48, the dial member 44 having a central aperture through which the shaft 32 extends. With reference to FIG. 4, a threaded fastener 50 secures the mounting member 46 to the dial member 44. The indicator 18 cooperates with the degree scale on the dial member 44 to indicate the angular orientation of the mounting member 46. Dial member 44 is seen to also comprise an enlarged diameter member mounted on shaft 32 and its inner surface provides a bearing face which extends radially outwardly of the other end of aperture 33. Member 44 thus cooperates with handle 34 to provide a first mounting means which serves to retain shaft 32 against axial movement during rotation thereof.

As an aid in zeroing the rotational position of the shaft 32 and mounting member 46, the pin 24 is biased into engagement with a recess in the shaft 32 when the mounting member 46 is horizontal. As the shaft 32 is rotated the pin 24 is cammed out of the recess.

Turning to the configuration of the mounting member 46 in more detail, it has a generally U-shaped cross section comprising a web portion 52 and a pair of spaced legs 54 each of which has a flange 56 projecting inwardly from the free longitudinal edge thereof in spaced parallel relation to the web 52 to define a channel 57 therebetween. The legs 54 and flanges 56 provide a track for a purpose described hereinafter. The upper surface of the mounting member 46 has a pair of adjustable L-shaped stop members 58 secured thereto adjacent opposite ends thereof by threaded fasteners 60, scales 62 indicating the position of the stop members 58. A mark 64 indicates the longitudinal center of the mounting member 46 and is aligned with the rotational axis of the shaft 32. A zeroing pin 66 seats in an aperture in the web portion 52 and is biased outwardly thereof toward the channel 57 for a purpose described hereinafter by a spring 68 intermediate the pin 66 annd dial member 44.

A slide member generally designated by the numeral 70 is slidably mounted on the track defined by the legs 54 and flanges 56 of the mounting member 46 for linear movement therealong between the stop members 58. If no such movement is desired the stop members 58 may be set abutting opposite ends of the slide member 70. Thus slide member 70 may either be fixed in place or be free for selected limited movement along the track.

The slide member 70 has a generally H-shaped cross section comprising a pair of spaced vertical legs 72 joined by a neck portion 74, one leg **72*a* having a lesser vertical dimension than the other leg 72*b* and being slidably seated intermediate the flanges 56 and web portion 52 of the mounting member 46 with the neck portion 74 disposed in the channel 57. The leg 72*b* has a vertically extending projection 76 on the surface opposite the leg 72*a* and a scale 78 on a vertical side surface thereof. As indicator mark 80 on the top surface of the slide member 70 indicates the center line thereof and cooperates with the mark 84 on the mounting member 46 to indicate alignment of the center of the slide member 70 with the rotational axis of the shaft 32. When so aligned the pin 66 is biased into engagement with a recess in the leg 72*a*, and is cammed out of the recess upon movement of the slide member 70** from the zeroed position thereof.

A slide block generally designated by the numeral 84 is slidably mounted on the slide member 70 for linear movement perpendicular to the track defined by the legs 54 and flanges 56 of the mounting member 46 and comprises a body portion 86 having a pair of wing portions 88 projecting perpendicularly therefrom at one end thereof. A vertically extending channel 90 intermediate the wing portions 88 slidably receives the projection 76 of the slide member 70 with the wing portions 88 abutting the leg **72*b* of the slide member 70**.

Figure 3:
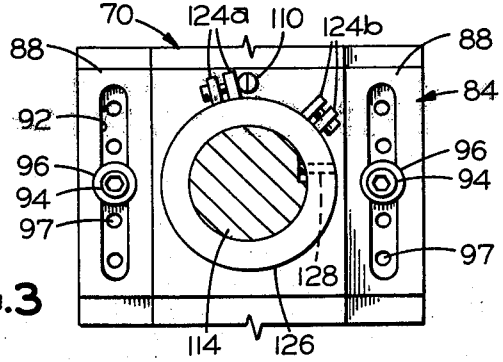
FIG. 3 is a fragmentary sectional view along the line 3—3 of FIG. 1.

As shown in FIG. 3, each wing portion 88 has a vertical slot 92 through which extends a threaded fastener 94 securing the slide block 84 to the slide member 70 at the desired relative position, a washer 96 being disposed intermediate the head of each fastener 94 and a wing portion 88. The fasteners 94 may seat in any of a multiplicity of vertically disposed apertures 97 in the slide member 70 to extend the range of travel of the slide block 84. An indicator mark 98 on a vertical edge surface of one of the wing portions 88 cooperates with the scale 78 to show the relative position of the slide block 84 and slide member 70.

The slide block 84 has a through extending second cylindrical aperture 100 having a countersunk larger diameter bore 102 intermediate the wing portions 88. A zeroing pin 104 seats in an aperture in the upper surface of the slide block 84 and is biased inwardly of the aperture 100, for a purpose described hereinafter, by a spring 106 retained in position by a set screw 108. A combination indicator/stop pin 110 is secured within a recess in the slide block 84 and extends horizontally outwardly of the end thereof opposite the slide member 70.

Figure 7:
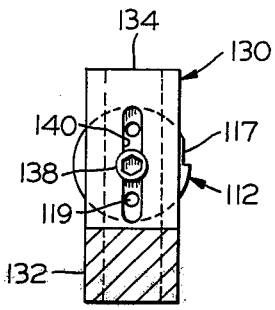
FIG. 7 is a fragmentary sectional view along the line 7—7 of FIG. 1.
Figure 6:
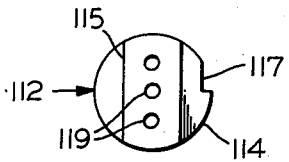
FIG. 6 is an end elevational view of the shaft to which the tool support member is secured.
Figure 5:
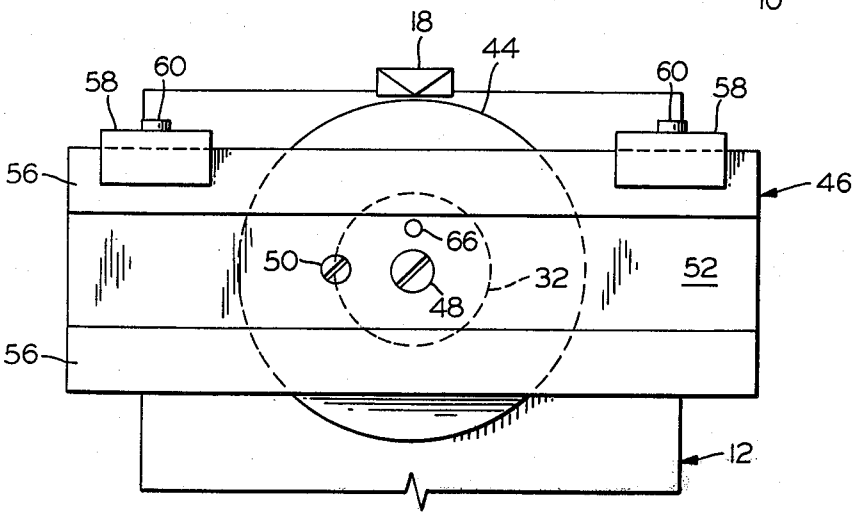
FIG. 5 is a fragmentary sectional view along the line 5—5 of FIG. 1.
Figure 8:
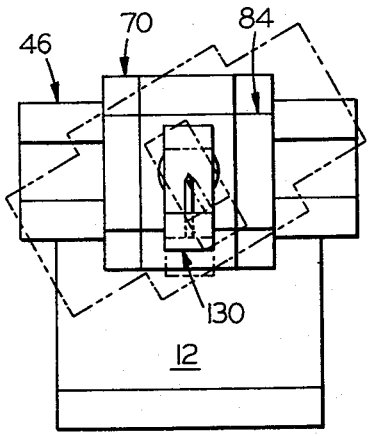
FIG. 8 is an end elevational view to a reduced scale of the dresser of FIG. 1 with phantom lines indicating a rotated position of the elements thereof.
Figure 9:
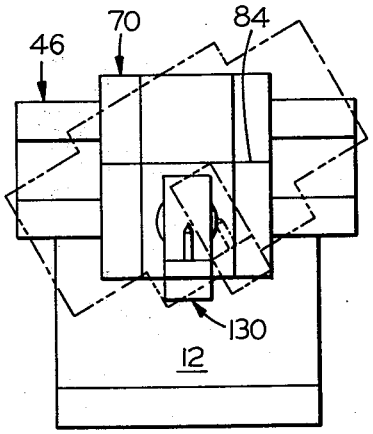
FIG. 9 is a view similar to that of FIG. 8 with the slide block and tool support member transposed relative to the position of FIG. 8.
Figure 10:
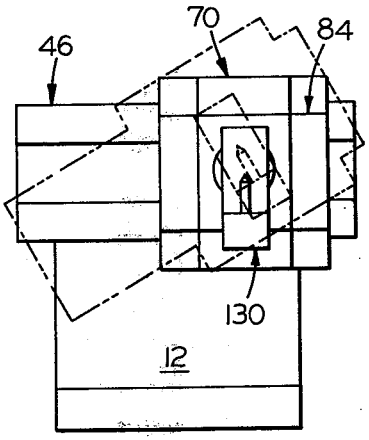
FIG. 10 is another view similar to that of FIG. 8 with the slide member transposed relative to the position of FIG. 8.

Rotatably seated in the bore 100 is a second shaft 112 having a circular cross sectioned end portion 114 of larger diameter extending outwardly of the slide block 84 which has a notch 117 the horizontal surface of which is coplanar with the rotational axis of shaft 112. Suitable bearing means (not shown) may be provided to reduce friction. The end portion 114 has a vertically extending projection 113 with parallel side surfaces extending parallel to the rotational axis of the shaft 112. As shown in FIGS. 6 and 7, the projection 115 has a multiplicity of vertically spaced threaded apertures 119 therein.

Threaded fastener 120 secures a spring washer 116 and washer 118 to the shaft 112.

Washers 116/118 thus provide an enlarged diameter member mounted on shaft 112 and the inner surface of washer 116 provides a bearing face which extends radially outwardly of one end of aperture 100. Larger diameter end portion 114 of shaft 112 has one end disposed adjacent the other end of aperture or bore 100. The shoulder formed by enlarged diameter portion 114 provides a bearing face which extends radially outwardly of its end of aperture 100 (similarly to enlarged diameter portion 34 of shaft 32) and cooperates with washers 116/118 to provide second mounting means retaining second shaft 112 against axial movement during rotation thereof.

A pair of annular clamp members generally designated by the numeral 122, identical in configuration to the clamp members 36, extend about the end portion 114 of the shaft 112 adjacent the slide block 84 and function in the same manner as the aforedescribed clamp members 36 to limit rotation of the shaft 112 with the legs **124*a*, *b* straddling the stop pin 110**.

That is, like the clamp members and pin associated with first shaft 32, clamp members 122 and pin 110 cooperate to provide the second shaft locking means to selectively either lock second shaft 112 for rotation with shaft 132 or to permit limited rotation, or more specifically, rotary oscillation, of second shaft 112 relative to first shaft 32. An annular diam member 126 graduated in degrees seats about the end portion 114 of the shaft 112 and is secured in position by a pin 128 extending therethrough into abutment with the vertical surface of the notch 117, the dial member 126 cooperating with the pointed end of the pin 110 to indicate the rotational position of the shaft 112. When the projection 115 of the shaft 112 is vertical the pin 104 is biased into engagement with a recess in the shaft 112 to facilitate zeroing the dresser 10, the pin 104 being crammed out of the recess upon rotation of the shaft 112.

An L-shaped tool support member generally designated by the numeral 130 is slidably mounted to the shaft 112 for linear movement perpendicular to the rotational axis thereof, and comprises a horizontal leg 132 and vertical leg 134. The leg 134 has a channel 136 in which is slidably seated the projection 115 of the shaft 112. With reference to FIG. 7, the tool support member 130 is secured to the shaft 112 by a threaded fastener 138 which extends through a slot 140 in the leg 134 and into engagement with one of the apertures 119 in the shaft 112. A cutting tool 142 seats in an aperture through the leg 132 adjacent the free end thereof and is retained in position by a set screw 144. As seen in FIG. 1, the tool 142 is in contact with the edge surface of a grinding wheel 146.

The operation of the radius and angle dresser 10 will now be described, in particular the mode of operation wherein tangent concave/convex or double radius surfaces are formed in a grinding wheel edge surface. Since the dresser 10 has two independently rotatable shafts 32, 112 and the cutting edge of the tool 142 may be set above or below the axis of each shaft 32, 112 individually, blended concave and/or convex edge surfaces having two different radii of curvature may be generated in a wheel utilizing a single initial setting of the two desired radii. That is, re-setting or re-zeroing between radius generations is not required.

Initially the dresser 10 is zeroed by positioning and mounting member 46 horizontally, centering the slide member 70 along the mounting member 46, and positioning the slide block 84 vertically so the rotational axes of the shafts 32, 112 are coaxial. The spring biased pins 24, 66, 104 described hereinbefore facilitate this zeroing procedure.

The position of the cutting tip of the tool 142 is then set at the desired elevation above or below the rotational axis of the shaft 112 depending on the radius to be generated and whether it is to be concave or convex. To make this setting a conventional height gauge (not shown) seated on the table 30 is first zeroed with respect to the horizontal surface of the notch 117 and then positioned adjacent the tool 142. The tool support member 130 is then moved vertically to position the tip of the tool 142 above or below the axis of shaft 112. Alternatively, the tool 142 itself may be moved vertically the desired amount.

The cutting tip of the tool 142 is next positioned above or below the rotational axis of shaft 32 by raising or lowering the slide block 84 the desired amount, bearing in mind that the tool tip has been positioned above or below the axis of shaft 112 by a known distance which must be taken into account when setting its elevation with respect to shaft 32 with scale 78 and mark 98. Alternatively, a height gauge may also be used for this setting.

Once the cutting tip of the tool 142 has been positioned it is brought into engagement with a grinding wheel edge surface. The radius set with respect to shaft 32 is first generated by rotating the handle 34 the desired amount, the degree of rotation being controlled by the clamp members 36. Since the shaft is actually oscillated back and forth with complete (360°) rotation, rotary oscillation may be a more precise form. During this operation the clamp members 122 are set to prevent rotation of shaft 112 and the stop members 58 are set to prevent movement of the slide member 70. Following generation of the first radius, clamp members 36 are set to prevent rotation of shaft 32 and clamp members 122 are reset to permit the desired degree of rotation of shaft 112. The second radius is then generated by manually rotating the tool support member 130. If only a single radius is to be formed the cutting tip of the tool 142 is set relative to only one of rotational axes.

In a manner well known in the art an angled surface may also be dressed into a grinding wheel in combination with one or two arcuately configured edge surface portions by rotating the handle 34 the desired degree, locking the shaft 32 by tightening the clamp members 36, and sliding the slide member 70 along the mounting member 46 between preset stop members 58. If such an angled surface is to be generated it should be formed subsequent to a radius generated by rotation of the handle 34 so that this radius of curvature corresponds to the position of the cutting tip of the tool 142 relative to the rotational axis of shaft 32. If a second radius is to be generated it may be done as described hereinbefore prior to or subsequent to generation of the angled surface and thus independently of the angular orientation of the mounting member 46.

Turning now to FIGS. 11–14, illustrated therein are examples of various grinding wheel edge configurations which may be formed by the dresser 10 as described hereinbefore. As will be apparent to one familiar with the art, innumerable combinations of blended concave and/or convex and/or angled surface may be generated in a wheel by the dresser 10 utilizing a single initial setting of the desired radii.

Figure 11:
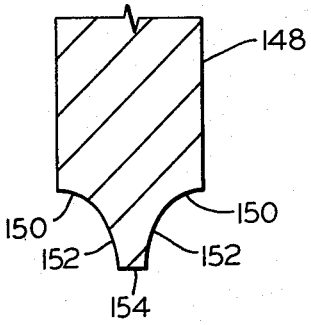
FIG. 11 is a fragmentary sectional view of a grinding wheel having an edge configuration generated by the present invention.

In FIG. 11 a grinding wheel 148 has two arcuate portions each having two blended concave surfaces 150, 152 with different radii of curvature. The flat portion 154 is a portion of the edge surface of the wheel 148.

Figure 12:
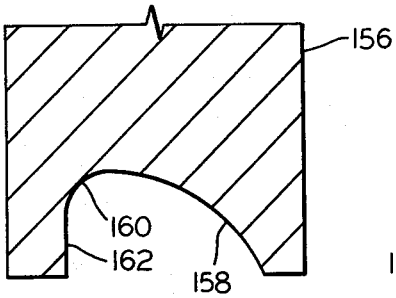
FIG. 12 is a similar fragmentary sectional view showing another grinding wheel configuration produced by the dresser of the present invention.

In FIG. 12 a grinding wheel 156 has a single arcuate portion comprising two blended concave surfaces 158, 160 with different radii of curvature. Surface 160 is first generated by rotation of handle 34 followed by surface 158 or 162, surface 158 being formed by rotation of the tool support member 130 and surface 162 being formed by linear movement of the slide member 70 along a vertically oriented mounting member 46.

Figure 13:
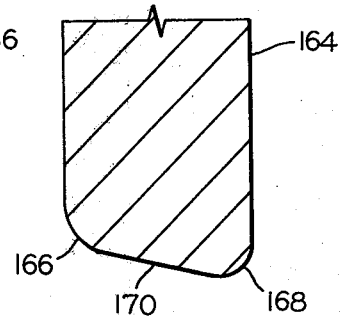
FIG. 13 is a similar sectional view of still another grinding wheel.

FIG. 13 shows a grinding wheel 164 having two convex edge surface portions 166, 168 of different radii of curvature and an angled surface 170. Surface 166 or 168 is first generated by rotation of the handle 34, surface 170 being generated next followed by the other of the surfaces 166, 168 which is formed by rotation of the tool support member 130.

Figure 14:
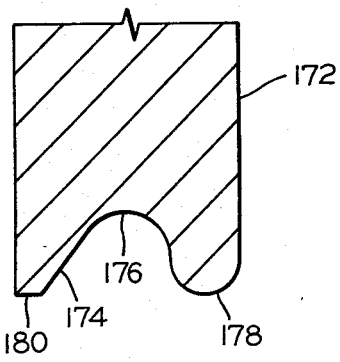
FIG. 14 is a similar view of still another grinding wheel.

FIG. 14 shows a grinding wheel 172 having an angled edge surface portion 174, concave edge surface portion 176, and convex edge surface portion 178. The flat portion 180 is a part of the edge surface of the wheel 172. Surface 176 is generated first, followed by surface 174 or surface 178.

Angular surfaces such as surface 170 and 174 are generated by shifting second shift 112 back and forth along the track of mounting member 46. The stops 58 are set to provide the required distance between them.

The preferred configurations of the various elements of the present invention are as described hereinbefore, but may take other forms as long as the essential features of the radius and angle dresser are present. More specifically, the dresser must have two independently rotatable parallel shafts, and the cutting tip of a tool must be adjustable between extreme positions on opposite sides of the rotational axis of each shaft individually. As an example of alternate structures for various elements, the configurations of the mounting member and slide member may be interchanged. That is, the mounting member may have an H-shaped cross section providing a track along which a generally U-shaped slide member is slidable.

Thus, it can be seen that the present invention provides a novel radius and angle dresser and a novel method for forming the edge surface of a grinding wheel to various compound configurations with an initial setting of the radii to be generated. The radius and angle dresser is capable of forming tangent concave and convex and double radius grinding wheel edge surface configurations.

Generally, the axes of rotation of the first and second shafts are parallel to each other. Rotational centering of the shafts is intended to mean the situation obtaining when the shafts are at this rotational zero positions.

It will be apparent that upon a reading and understanding of the foregoing, modifications to the described preferred embodiment will occur to those skilled in the art, which modifications are nonetheless intended to include such modifications within the scope of the appended claims.

Having thus described the invention, I claim:

1. A radius and angle dresser comprising:

A. A support member having a first cylindrical aperture extending therethrough;

B. a first shaft on said support member;

C. first mounting means on said first shaft mounting said first shaft in said first aperture for rotation, without axial movement, relative to said support member;

D. first shaft locking means operatively connected between said first shaft and said support member to selectively limit rotation of said first shaft from no rotation to limited rotary oscillation relative to said support member;

E. a mounting member secured to an end of said first shaft for rotation therewith about the axis of rotation of said first shaft and having a linear track extending perpendicularly to said axis of rotation of said first shaft;

F. a slide member slidably mounted on said track for linear movement along said track perpendicularly of said axis of rotation of said first shaft;

G. means for limiting movement of said slide member along said track;

H. a slide block having a second cylindrical aperture extending therethrough and slidably mounted on said slide member for linear movement thereon perpendicularly to the longitudinal axis of said track and to said axis of rotation of said first shaft;

I. means for locking said slide block in a selected fixed position along said slide member;

J. a second shaft on said slide block, the axis of rotation of said second shaft being parallel to that of said first shaft and perpendicular to the longitudinal axis of said track;

K. second mounting means on said second shaft mounting said second shaft in said second aperture for rotation about the longitudinal axis of said second shaft, without axial movement, relative to said slide block, said second shaft being oscillatable in said second aperture independently of movement of said first shaft;

L. second shaft locking means operatively connected between said second shaft and said slide block to selectively limit rotation of said second shaft from no rotation to limited rotary oscillation relative to said slide block;

M. a tool support member mounted adjacent an end of said second shaft for movement perpendicularly to said axis of rotation of said second shaft;

N. means for locking said tool support member in a fixed position on said second shaft;

O. cutting tool mounting means on said tool support member for mounting a cutting tool to provide a cutting edge thereof angularly disposed relative to the axes of rotation of said shafts; and P. means for oscillating said first shaft within said support member without effecting axial movement thereof to oscillate the entire subassembly supported thereon about its axis of rotation, said cutting tool support member being oscillatable on said second shaft about the axis of said second shaft independently of oscillation of said first shaft;

said tool support member being moveable on said second shaft to move the cutting edge of the associated cutting tool between extreme positions on opposite sides of the axis of rotation of said second shaft, and said slide block being slidable on said slide member to move the cutting edge of the associated cutting tool between extreme positions on opposite sides of said axis of rotation of said first shaft;

whereby appropriate settings of said first and second shaft locking means may be employed to rotate said first shaft during operation of said dresser for rotation of said second shaft therewith to oscillate the associated cutting tool about the axis of rotation of said first shaft, and to rotate said second shaft during operation of said dresser independently of said first shaft to oscillate the associated cutting tool about the axis of rotation of the second shaft, each of said shafts thereby being independently oscillatable to effect oscillation of the cutting tool across the surface of a workpiece rotating in contact therewith.

2. The radius and angle dresser of claim 1 wherein said first mounting means comprises two elements spaced apart along and mounted on said first shaft and disposed, respectively, adjacent opposite ends of said first cylindrical aperture, said elements each having a bearing face extending radially outwardly of said first aperture to provide respective bearing shoulders retaining said first shaft axially immovably within said first aperture.

3. The radius and angle dresser of claim 2 wherein said second mounting means comprises two elements spaced apart along and mounted on said second shaft and disposed, respectively, adjacent opposite ends of said second cylindrical aperture, said elements each having a bearing face extending radially outwardly of said second aperture to provide respective bearing shoulders retaining said second shaft axially immovably within said second aperture.

4. The radius and angle dresser of claim 1 wherein said tool support member has an L-shaped configuration defined by a pair of legs, one of said legs being slidably mounted on said end of said second shaft and extending generally perpendicularly to said rotational axis thereof with the other of said legs extending generally parallel to said rotational axis thereof and having said cutting tool mounting means thereon.

5. The radius and angle dresser of claim 4 wherein the end portion of said second shaft adjacent said end thereof has a pair of spaced parallel surfaces extending parallel to the rotational axis thereof and wherein said one leg of said tool support member has a cooperatively configured channel in which is slidably received said end portion of said second shaft.

6. The radius and angle dresser of claim 1 wherein said first shaft locking means comprises first stop means mounted on said first shaft and a first stop member mounted on said support member, said first stop means cooperating with said first stop member to limit rotation of said first shaft.

7. The radius and angle dresser of claim 1 wherein said second shaft locking means comprises second stop means mounted on said second shaft and a second stop member mounted on said slide block, said second stop means cooperating with said second stop member to limit rotation of said second shaft.

8. The radius and angle dresser of claim 1 further including first dial means mounted on said first shaft for rotation therewith and a first indicator member mounted on said support member, said first dial means cooperating with said first indicator member to indicate the rotational orientation of said first shaft.

9. The radius and angle dresser of claim 1 further including second dial means mounted on said second shaft for rotation therewith and a second indicator member mounted on said slide block, said second dial means cooperating with said second indicator member to indicate the rotational orientation of said second shaft.

10. The radius and angle dresser of claim 3 wherein at least one of said elements mounted on said first shaft comprises an enlarged diameter portion of said first shaft and said enlarged diameter portion comprises a handle means for effecting rotary oscillation of said first shaft.

11. The radius and angle dresser of claim 3 wherein said second shaft has an end portion thereof which extends outwardly of said slide block and is adapted to serve as second handle means for rotary oscillation of said second shaft.

* * * * *